US007663467B2

(12) United States Patent
Hsu

(10) Patent No.: US 7,663,467 B2
(45) Date of Patent: Feb. 16, 2010

(54) MANUALLY RESETTABLE THERMOSTAT

(76) Inventor: Chia-Yi Hsu, B1, No. 8, Lane 92, Sec. 1, Jianguo N. Rd., Taipei City (TW)

( * ) Notice: Subject to any disclaimer, the term of this patent is extended or adjusted under 35 U.S.C. 154(b) by 163 days.

(21) Appl. No.: 12/084,563

(22) PCT Filed: Sep. 14, 2006

(86) PCT No.: PCT/CN2006/002402

§ 371 (c)(1),
(2), (4) Date: May 6, 2008

(87) PCT Pub. No.: WO2007/051386

PCT Pub. Date: May 10, 2007

(65) Prior Publication Data

US 2009/0115566 A1 May 7, 2009

(51) Int. Cl.
*H01H 37/52* (2006.01)

(52) U.S. Cl. ..... 337/336; 337/337; 337/338; 337/339; 337/340; 337/343; 337/348; 337/380

(58) Field of Classification Search ..... 337/336–340, 337/343, 348, 380
See application file for complete search history.

(56) References Cited

U.S. PATENT DOCUMENTS 2,324,161 A * 7/1943 Holmes ..... 361/26
2,446,831 A * 8/1948 Hottenroth, Jr. ..... 337/38
2,471,924 A * 5/1949 Bolesky ..... 60/529
3,582,853 A * 6/1971 Morris ..... 337/102
3,621,434 A * 11/1971 Gerich ..... 337/248
3,662,311 A * 5/1972 Snider et al. ..... 337/367
3,852,697 A * 12/1974 Snider ..... 337/348
3,852,698 A * 12/1974 Schmitt et al. ..... 337/354
3,861,032 A * 1/1975 Schmitt ..... 29/623
3,943,478 A * 3/1976 Place ..... 337/347
3,943,480 A * 3/1976 Schmitt ..... 337/371
4,027,385 A * 6/1977 Deubel ..... 29/622
4,035,756 A * 7/1977 Schmitt ..... 337/370
4,481,494 A * 11/1984 Anderson et al. ..... 337/95
4,843,364 A * 6/1989 Place et al. ..... 337/333
4,942,381 A * 7/1990 Cambien ..... 337/370
5,023,744 A * 6/1991 Hofsass ..... 361/26
5,243,315 A * 9/1993 Rose ..... 337/354
5,270,799 A * 12/1993 Rose ..... 337/354
5,828,286 A * 10/1998 Hofsass ..... 337/343
5,867,085 A * 2/1999 Kruck et al. ..... 337/380

(Continued)

FOREIGN PATENT DOCUMENTS

DE 2432901 A * 1/1976

(Continued)

*Primary Examiner*—Anatoly Vortman

(57) ABSTRACT

A manually resettable thermostat has several individual resettable thermostats which have respective calibration temperature, stacked one above the other and formed as an integral assembly. The thermostat may be utilized in the thermostatic system that need several different manually resettable thermostats with different calibration temperatures so the space of the system is saved and the operation of the thermostat is simplified.

5 Claims, 3 Drawing Sheets

U.S. PATENT DOCUMENTS 5,877,671 A * 3/1999 Hofsass ..... 337/343
5,905,620 A * 5/1999 Becher et al. ..... 361/105
5,929,742 A * 7/1999 Short ..... 337/348
6,580,351 B2 * 6/2003 Davis et al. ..... 337/111
6,597,274 B1 * 7/2003 Nguyen ..... 337/377
6,724,294 B2 * 4/2004 Morbitzer ..... 337/394
6,891,464 B2 * 5/2005 Scott et al. ..... 337/343
7,218,200 B2 * 5/2007 Hayashi et al. ..... 337/348

FOREIGN PATENT DOCUMENTS

DE 2640181 A * 3/1978
EP 187232 A2 * 7/1986

* cited by examiner

TEMPERATURE t>t2>t1
T2
3
4
T1
3
4

2
1
t2>TEMPERATURE t>t1
T2
3
4
T1
3
4

2
1
t2>t1>TEMPERATURE t
T2
3
4
T1
3
4

2
1
T2
3
4
T1
3
4

F
THE PROCESS OF TEMPERATURE DROPPING

MANUALLY RESETTABLE THERMOSTAT

BACKGROUND OF THE INVENTION

1. Field of the Invention

The present invention relates to bimetal snap-action type temperature control devices and more particularly, to a thermostat device, which has multiple manually resettable thermostat units arranged in a stack for working individually at different temperature ranges, and which allows a user to reset all the manually resettable thermostats at a time through one single action.

2. Description of the Related Art

According to the design of a conventional manually resettable bimetal snap-action thermostat, the bimetal snap-action spring plate is caused to curve from a first position to a second position when the temperature rises over a predetermined temperature. When the temperature drops below the predetermined temperature, the bimetal snap-action spring plate returns from the second position to the first position. At this time, the switch circuit is not reset, and an external force must be applied to reset the thermostat. This type of manually resettable thermostat has the advantages of high reliability and ease of use. Therefore, this type of manually resettable thermostat is intensively used in different fields. However, this type of manually resettable thermostat is workable only at one single temperature point. For multiple temperature control point application, multiple manually resettable thermostats shall be used. In case there is no sufficient installation space for multiple manually resettable thermostats, the aforesaid conventional design becomes useless.

For example, when designing an automatic rice cooker, as shown in FIG. 5, it is necessary to rapidly increase the heating temperature to a first temperature point $t_1$, i.e., the food safety temperature about 60~75° C. to kill microbes in rice, and then to lower the heating power for enabling the heating temperature to be increased slowly to a second temperature point $t_2$, i.e., the saturation temperature about 85~95° C. to have rice be well cooked, and then to lower the heating temperature to a third temperature point $t_3$, i.e., the warm-keeping temperature about 60~65° C. It is the most economic and convenient way to detect the first temperature point $t_1$ and the second temperature point $t_2$ by means of the use of a snap-action type thermostat. However, when the temperature drops, the snap-action type thermostat does not return to its former position automatically, i.e., it cannot let the heating temperature drop to the warm-keeping temperature point $t_3$ to keep the cooked rice warm. This warm-keeping temperature point $t_3$ is lower than the saturation temperature point $t_2$. For the control of the first temperature point $t_1$ and the second temperature point $t_2$, a manually resettable thermostat can be used. The best installation position for thermostat between the electric heater and the cooker is the center area. However, the available space around this center area is limited. In a rice cooker, this space is sufficient for accommodating one single manually resettable thermostat. When multiple manually resettable thermostats are arranged together, the resetting mechanism will be complicated.

SUMMARY OF THE INVENTION

The present invention has been accomplished under the circumstances in view. It is the main object of the present invention to provide a thermostat device, which is suitable for use in a temperature control system that requires control of multiple temperature points and, which is easy to operate and saves much installation space.

To achieve this and other objects, the thermostat device comprises a plurality of manually resettable thermostat units arranged in a stack. The manually resettable thermostat units act at different temperature ranges. Each manually resettable thermostat unit comprises a thermoconducting top cover, a bottom cover, an intermediate structure set in between the thermoconducting top cover and the bottom cover, a smoothly arched bimetal snap-action spring plate for switching on/off a circuit subject to change in temperature, a center push rod inserted axially slidably inserted through the respective intermediate structure. The smoothly arched bimetal snap-action spring plate, the thermoconducting top cover and the bottom cover each have a center through hole for the passing of the respective center push rod. The center through hole of the thermoconducting top cover of one lower manually resettable thermostat unit allows the center push rod of the adjacent upper manually resettable thermostat to pass such that said manually resettable thermostat units work individually at a respective different temperature range and are simultaneously manually resettable. The manually resettable thermostat units are arranged in a stack in such an order that the manually resettable thermostat unit that is disposed at a lower side acts at a relatively lower temperature range than the manually resettable thermostat unit that is disposed at an upper side.

The thermostat device further comprises a thermoconducting housing surrounding the manually resettable thermostat units and disposed in connection with the thermoconducting top covers of the manually resettable thermostat units for quick transfer of heat energy to keep the thermoconducting top covers of the manually resettable thermostat units at a same temperature.

The thermostat device further comprises at least one automatically resettable thermostat unit arranged on the top side of the manually resettable thermostat units.

The thermostat device further comprises a thermal insulative covering surrounding the thermoconducting housing. The thermal insulative covering is preferably prepared from glass fiber cloth.

Further, the center push rod of each manually resettable thermostat unit has its top end normally kept in flush with the associating thermoconducting top cover, and its bottom end normally kept in flush with the associating bottom cover.

By means of the aforesaid arrangement, the manually resettable thermostat units work individually at different temperature ranges, however the manually resettable thermostat units are manually resettable at a the same time through one single action. Therefore, the thermostat device of the present invention saves much installation space, and is easy to operate.

DETAILED DESCRIPTION OF THE PREFERRED EMBODIMENT

Figure 1:
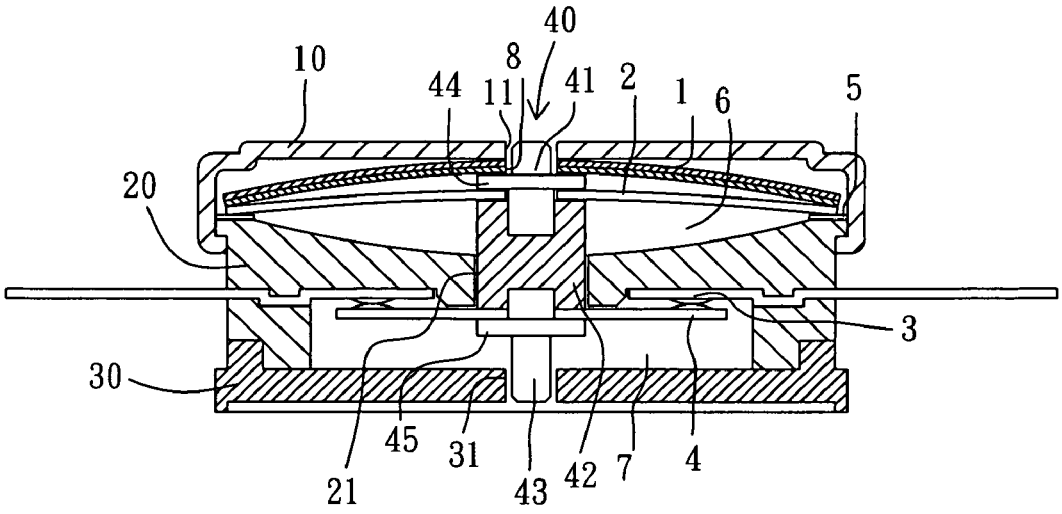
FIG. 1 is a schematic sectional view of a thermostat constructed in accordance with the present invention.

Referring to FIG. 1, a manually resettable thermostat device in accordance with the present invention is shown comprising a thermoconducting metal top cover 10, an intermediate structure 20, which has a center guide hole 21, a bottom cover 30, a center push rod 40 axially movably inserted through the center guide hole 21 of the intermediate structure 10, a first accommodation chamber 6 defined in between the thermoconducting metal top cover 10 and the intermediate structure 20, a second accommodation chamber 7 defined in between the intermediate structure 20 and the bottom cover 30, a smoothly arched bimetal snap-action spring plate 1 made out of two metals having different thermal expansion coefficients and coupled to the center push rod 40 and suspending in the accommodation chamber 6, at least one first metal contact 3 fixedly mounted in the second accommodation chamber 7, and a second metal contact 4 affixed to the center push rod 40 and normally kept in contact with the first metal contact 3. When reached the designed temperature point, the smoothly arched bimetal snap-action spring plate 1 is caused to make a snap action and to curve in the reversed direction from the upwardly curved first stable state position to the downwardly curved second stable state position. At this time, the reaction force of the snap action of the smoothly arched bimetal snap-action spring plate 1 forces the center push rod 40 downwards, and therefore the second metal contact 4 is moved with the center push rod 40 downwardly away from the first metal contact 3 to open the circuit (see the status of the first thermostat T1 shown in FIG. 2).

Figures 3A, 3B, 3C, 3D:
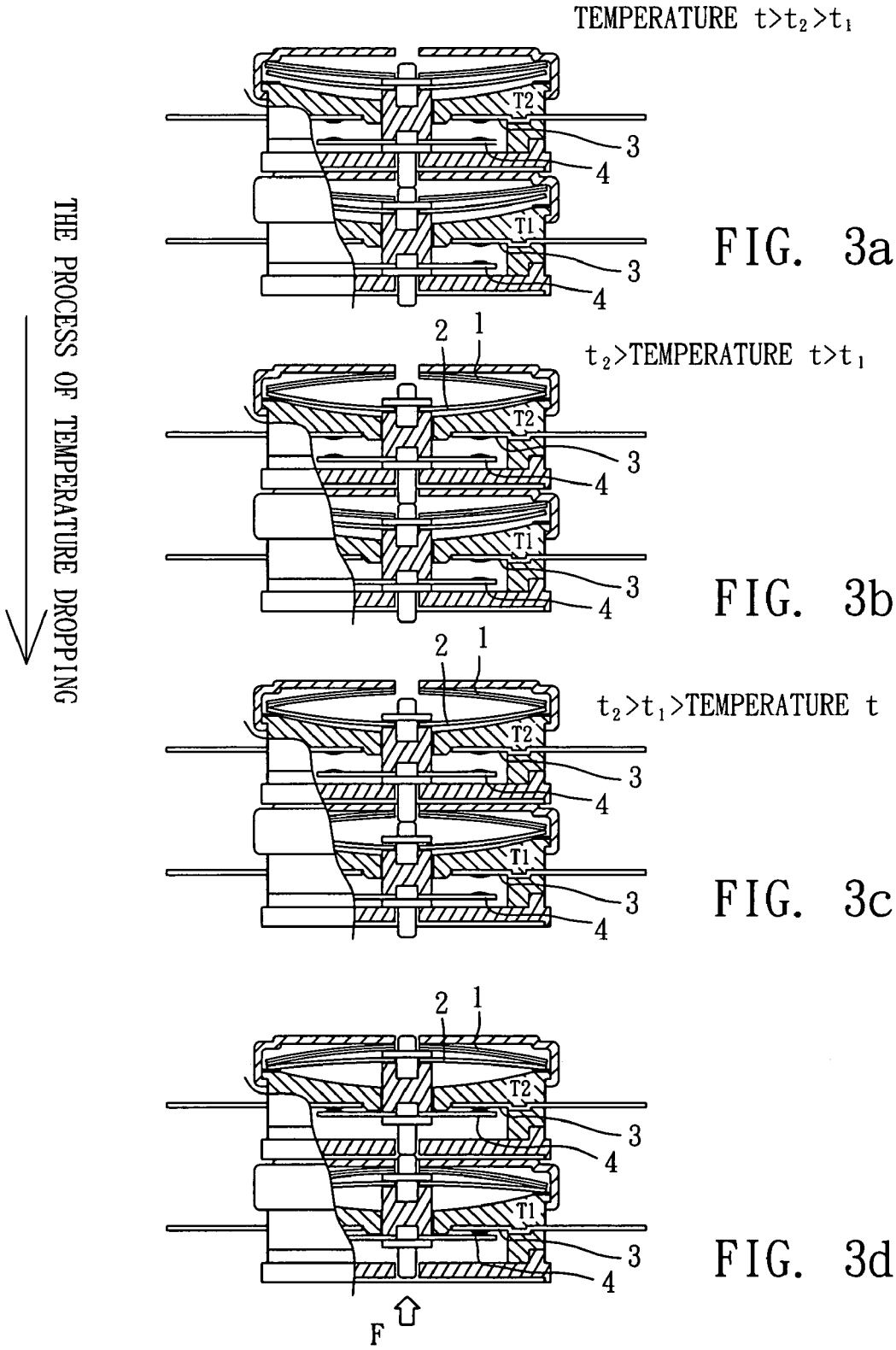
FIGS. 3*a*-3*d* are schematic drawings showing different operation status of the manually resettable thermostat device shown in FIG. 2.

When the temperature reached the snap-action temperature $t_2$ of the second thermostat T2 that is stacked on the first thermostat T1, the smoothly arched bimetal snap-action spring plate of the second thermostat T2 is caused to make a snap action and to curve in the reversed direction from a first stable state position to a second stable state position (see FIG. 3*a*). At this time, the first thermostat T1 and the second thermostat T2 are off. When the temperature starts to drop at this time and when it reaches the working temperature point $t_2$ of the smoothly arched bimetal snap-action spring plate 1 of the second thermostat T2 ($t_2>t_1$), the smoothly arched bimetal snap-action spring plate 1 of the second thermostat T2 is caused to return to its upwardly curved first stable state position, as shown in FIG. 3*b*. However, this action does not cause the center push rod 40 to displace, and therefore the smoothly arched metal spring plate, referenced by 2, remains in its downwardly curved second stable state position, and the metal contacts 3 and 4 are kept in the broken circuit status. Further, in FIG. 1, the reference sign 5 indicates a metal gasket.

The center push rod 40 is a combination rod comprised of a main shaft 42, a top guide rod 41 and a bottom guide rod 43. The top guide rod 41 is inserted through a center through hole 8 of the smoothly arched bimetal snap-action spring plate 1 and the center through hole 11 of the thermoconducting metal top cover 10. The top guide rod 41 has a shoulder 44 that is kept in contact with the bottom surface of the smoothly arched bimetal snap-action spring plate 1 so that the center push rod 40 can be pushed downwards by the smoothly arched bimetal snap-action spring plate 1 when the smoothly arched bimetal snap-action spring plate 1 is caused to make a snap action and to curve from the upwardly curved first stable state position to the downwardly curved second stable state position.

The smoothly arched metal spring plate 2 is coupled to the center push rod 40 between the shoulder 44 of the top guide rod 41 and the topmost edge of the main shaft 42. The arched metal spring plate 2 can be curved from an upwardly curved first stable state position to a downwardly curved second stable state position. However, when the smoothly arched bimetal snap-action spring plate 1 is caused to curve from the downwardly curved second stable state position to the upwardly curved first stable state position, the center push rod 40 does no work, and at this time, the smoothly arched metal spring plate 2 is maintained in the downwardly curved second stable state position.

As shown in FIG. 3*c*, when the temperature keeps dropping to the level below the working temperature point $t_1$ of the smoothly arched bimetal snap-action spring plate 1 of the first thermostat T1, the smoothly arched bimetal snap-action spring plate 1 of the first thermostat T1 is caused to return to its upwardly curved first stable state position. At this time, same as the second thermostat T2, the metal contacts 3 and 4 of the second thermostat T2 are kept in the broken circuit status. Referring to FIG. 3*d*, the first thermostat T1 and the second thermostat T2 can be reset only when an external force, referenced by the reference sign "f", is introduced. Upon application of the external force "f", the first thermostat T1 and the second thermostat T2 are simultaneously reset, and the metal contacts 3 and 4 of each of the first thermostat T1 and second thermostat T2 are returned to the close circuit status.

Figure 2:
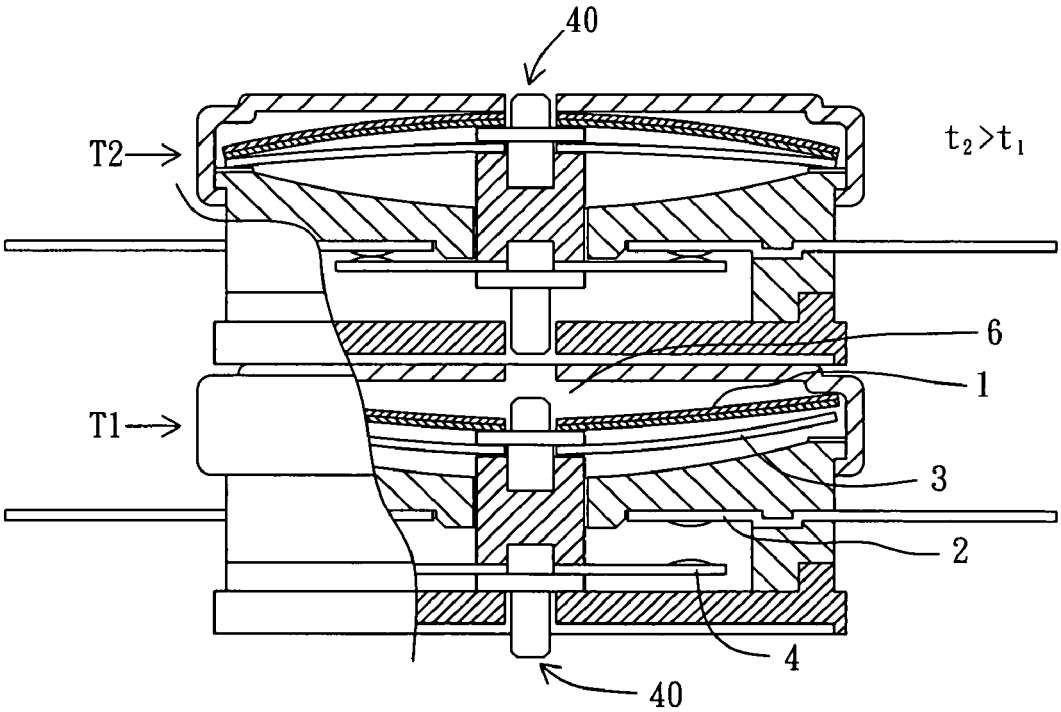
FIG. 2 is a schematic sectional view of a manually resettable thermostat device in accordance with the present invention.

During the assembly process of the present invention, the thermostat of which the smoothly arched bimetal snap-action spring plate has a relatively lower working temperature is provided at the bottom side of the bottom cover of the thermostat of which the smoothly arched bimetal snap-action spring plate has a relatively higher working temperature, keeping the respective center push rods 40 in vertical alignment, as shown in FIG. 2. Thus, when the temperature rises to the level of the working temperature of the smoothly arched bimetal snap-action spring plate of the lower thermostat (the first thermostat) T1, the respective smoothly arched bimetal snap-action spring plate is caused to curve from the upwardly curved first stable state position to the downwardly curved second stable state position, leaving the upper half of the first accommodation chamber 6 in vacant for the upper thermostat (the second thermostat) T2. Therefore, these two stacked thermostats T1; T2 work independently without interfering with each other.

Figure 4:
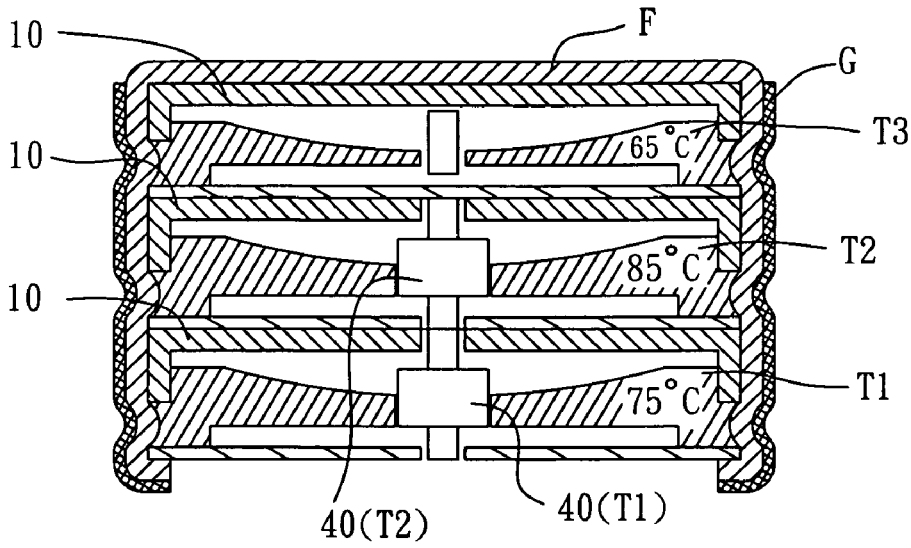
FIG. 4 is a schematic sectional view of an alternate form of the manually resettable thermostat device in accordance with the present invention.
Figure 5:
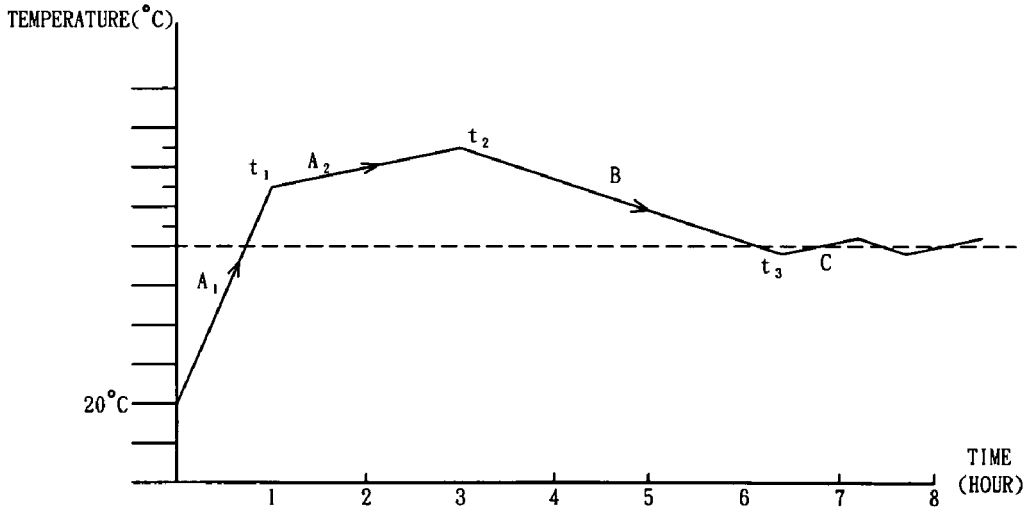
FIG. 5 is a schematic drawing showing the temperature control procedure of the manually resettable thermostat device shown in FIG. 4.

FIG. 4 is a schematic sectional view of an alternate form of the manually resettable thermostat device in accordance with the present invention. FIG. 5 is a schematic drawing showing the temperature control procedure of the manually resettable thermostat device shown in FIG. 4. According to this embodiment, T1 (75° C.) and T2 (85° C.) are manually resettable thermostats, T3 (65° C.) is an automatically resettable thermostat. The thermostat T1 is provided at the bottom side of the thermostat T2. The thermostat T3 is provided at the top side of the thermostat T2. Further, a thermoconducting housing F is provided to surround the stacked thermostats T1~T3. The thermoconducting housing F is made of a metal material having high thermal conductivity, for example, copper. Further, the thermoconducting metal top covers 10 of the thermostats T1~T3 are bonded to the thermoconducting housing F by, for example, welding, assuring high thermal conductivity. This embodiment further comprises a thermal insulative covering G surrounding the periphery of the thermoconducting housing F to avoid quick dissipation of heat. The thermal insulative covering G is preferably prepared from glass fiber cloth.

As stated above, the invention provides a thermostat device, which has multiple thermostats arranged in a stack and individually operable at different temperature levels. The thermostat device is easy to operate and saves much installation space, allowing all the thermostats be simultaneously reset through one single action.

Although particular embodiments of the invention have been described in detail for purposes of illustration, various modifications and enhancements may be made without departing from the spirit and scope of the invention.

What is claimed is:

1. A thermostat device, comprising a plurality of manually resettable thermostat units arranged in a stack, said manually resettable thermostat units acting at different temperature ranges, each said manually resettable thermostat unit comprising a thermoconducting top cover, a bottom cover, an intermediate structure set in between said thermoconducting top cover and said bottom cover, and a smoothly arched bimetal snap-action spring plate for switching on/off a circuit subject to change in temperature, wherein each said manually resettable thermostat unit comprises a center push rod inserted axially slidably through the respective intermediate structure, and the smoothly arched bimetal snap-action spring plate, thermoconducting top cover and bottom cover of each said manually resettable thermostat unit each have a center through hole for the passing of the respective center push rod; the center through hole of the thermoconducting top cover of one lower manually resettable thermostat unit allows the center push rod of the adjacent upper manually resettable thermostat unit to pass such that said manually resettable thermostat units work individually at a respective different temperature range and are simultaneously manually resettable;

said manually resettable thermostat units are arranged in a stack in such an order that the manually resettable thermostat unit that is disposed at a lower side acts at a relatively lower temperature range than the manually resettable thermostat unit that is disposed at an upper side.

2. The thermostat device as claimed in claim 1, further comprising a thermoconducting housing surrounding said manually resettable thermostat units and disposed in connection with the thermoconducting top covers of said manually resettable thermostat units for keeping the thermoconducting top covers of said manually resettable thermostat units at a same temperature.

3. The thermostat device as claimed in claim 2, further comprising at least one automatically resettable thermostat unit arranged on a top side of said manually resettable thermostat units.

4. The thermostat device as claimed in claim 2, further comprising a thermal insulative covering surrounding said thermoconducting housing, said thermal insulative covering being prepared from glass fiber cloth.

5. The thermostat device as claimed in claim 1, wherein the center push rod of each said manually resettable thermostat unit has a top end and a bottom end that are normally and respectively kept in flush with the thermoconducting top cover and bottom cover of the respective manually resettable thermostat unit.

* * * * *